US009229424B2

(12) United States Patent
Song

(10) Patent No.: US 9,229,424 B2
(45) Date of Patent: Jan. 5, 2016

(54) IMAGE FORMING APPARATUS

(71) Applicant: SAMSUNG ELECTRONICS CO., LTD., Suwon-si, Gyeonggi-do (KR)

(72) Inventor: Min Keun Song, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/258,244

(22) Filed: Apr. 22, 2014

(65) Prior Publication Data

US 2014/0334852 A1 Nov. 13, 2014

(30) Foreign Application Priority Data

May 8, 2013 (KR) ..... 10-2013-0052047

(51) Int. Cl.
*G03G 15/00* (2006.01)
*G03G 21/18* (2006.01)

(52) U.S. Cl.
CPC ..... *G03G 21/1821* (2013.01)

(58) Field of Classification Search
CPC ..... G03G 21/1676; G03G 21/16; G03G 21/1647; G03G 21/18; G03G 21/1842; G03G 21/1864
USPC ..... 399/119, 167, 279
See application file for complete search history.

(56) References Cited

U.S. PATENT DOCUMENTS 6,035,159 A * 3/2000 Azuma et al. ..... G03G 15/757 399/111
2008/0118271 A1* 5/2008 Kim et al. ..... 399/126
2009/0028605 A1* 1/2009 Mitamura et al. ..... 399/167
2009/0190958 A1* 7/2009 Wang et al. ..... 399/228

* cited by examiner

*Primary Examiner* — Walter L Lindsay, Jr.
*Assistant Examiner* — Jessica L Eley
(74) *Attorney, Agent, or Firm* — Staas & Halsey LLP

(57) ABSTRACT

An image forming apparatus is provided. The image forming apparatus includes a photosensitive body unit including a photosensitive body, at least one developing unit including a developing roller that is configured to contact the photosensitive body or to be separated from the photosensitive body, and a press device to press the developing unit in order to contact or separate the photosensitive body and the developing roller to/from each other. The press device includes at least one lever configured to rotate about an end portion thereof and press the developing unit by rotation, and at least one cam configured to allow the lever to rotate by rotation thereof. Since the lever gradually rotates by rotation of the cam, force applied to the developing unit through the lever is also gradually and smoothly increased or decreased. Accordingly, shock, which may occur by rough movement of the developing unit, is remarkably reduced.

19 Claims, 9 Drawing Sheets

IMAGE FORMING APPARATUS

CROSS-REFERENCE TO RELATED APPLICATIONS

This application is related to, and claims the priority benefit of, Korean Patent Application No. 10-2013-0052047, filed on May 8, 2013 in the Korean Intellectual Property Office, the disclosure of which is incorporated herein by reference.

BACKGROUND

1. Field

Embodiments relate to an image forming apparatus having a structure capable of contacting or separating developing rollers and photosensitive bodies to/from each other.

2. Description of the Related Art

An image forming apparatus refers to an apparatus that prints an image on a printing medium according to input signals. An image forming apparatus may be classified as a printer, a copying machine, a fax machine, a multi-function printer that has multiple functions including printing, scanning, copying and faxing, and the like.

An image forming apparatus comprises a photosensitive body unit including a photosensitive body therein, a laser scanning unit to form an electrostatic latent image on the photosensitive body, and a developing unit including a developing roller to form a visible image by supplying developers to the photosensitive body on which an electrostatic latent image is formed.

An image forming apparatus having a structure of supplying developers by contacting a developing roller to a photosensitive body operates such that a developing roller and a photosensitive body contact each other while an image forming process is performed, but are separated from each other to avoid interference therebetween while an image forming process is not being performed.

SUMMARY

It is an aspect of an exemplary embodiment to provide an image forming apparatus capable of reducing shock, which may occur during operation of a developing unit, by gradually increasing or decreasing force applied to the developing unit.

Additional aspects are set forth in part in the description which follows and, in part, will be obvious from the description, or may be learned by practice of the invention.

In accordance with an aspect of an embodiment, an image forming apparatus includes a photosensitive body unit including a photosensitive body, at least one developing unit including a developing roller that is configured to contact the photosensitive body or to be separated from the photosensitive body, and a press device to press the developing unit in order to contact or separate the photosensitive body and the developing roller to/from each other. The press device includes at least one lever configured to rotate about an end portion thereof and press the developing unit by rotation, and at least one cam configured to allow the lever to rotate by rotation thereof.

The cam may include a cam portion that extends in a circumferential direction thereof, and the lever may include a guide part that interacts with the cam portion so that the lever rotates in an axial direction of the cam.

The cam portion may include a cam recess that is concavely formed at an outer peripheral surface of the cam, and the guide part may include a guide protrusion that protrudes from the lever and is inserted into the cam recess.

The cam portion may include a cam protrusion that is convexly formed at an outer peripheral surface of the cam, and the guide part may include a pair of guide protrusions that protrude from the lever and between which the cam protrusion is inserted.

The cam portion may include a first cam portion that extends obliquely in a first direction and a second cam portion that extends obliquely in a second direction that is opposite to the first direction.

The at least one developing unit may include plural developing units. The at least one lever may include plural levers to respectively press the plural developing units. The at least one cam may include plural cams that respectively correspond to the plural levers. The cam portion of each of the plural cams may be shaped such that the first cam portion and the second cam portion are connected in order in a circumferential direction of the cam.

The first cam portion and the second cam portion may respectively extend by an angle of 180 degrees in a circumferential direction of the cam.

The cam portion may further include a third cam portion that extends in parallel with a rotating direction of the cam.

The at least one developing unit may include a first developing unit for a black and white developing process and plural second developing units for a color developing process. The at least one lever may include a first lever to press the first developing unit and plural second levers to respectively press the plural second developing units. The at least one cam may include a first cam to rotate the first lever and plural second cams to respectively rotate the plural second levers. The cam portion of the first cam may be shaped such that the first cam portion, the third cam portion and the second cam portion are connected in order in a circumferential direction of the first cam. The cam portion of each of the plural second cams may be shaped such that the first cam portion, the second cam portion and the third cam portion are connected in order in a circumferential direction of the second cams.

The at least one developing unit may include a first developing unit for a black and white developing process and plural second developing units for a color developing process. The at least one lever may include a first lever to press the first developing unit and plural second levers to respectively press the plural second developing units. The at least one cam may include a first cam to rotate the first lever and plural second cams to respectively rotate the plural second levers. The cam portion of the first cam may be shaped such that the first cam portion, the third cam portion and the second cam portion are connected in order in a circumferential direction of the first cam. The cam portion of each of the plural second cams may be shaped such that the third cam portion, the first cam portion and the second cam portion are connected in order in a circumferential direction of the second cams.

The first cam portion, the second cam portion and the third cam portion may respectively extend by an angle of 120 degrees in a circumferential direction of the cam.

The image forming apparatus may further include a drive shaft. The at least one cam may include plural cams coupled to the drive shaft and arranged apart from each other in an axial direction of the drive shaft.

The press device may include a worm configured to rotate by receiving rotational force and a worm wheel that is coupled to the drive shaft and tooth-engaged with the worm.

The developing unit may be rotatably coupled to the photosensitive body unit, and the press unit may press the developing unit to rotate the same so that the developing roller comes into contact with the photosensitive body.

The developing unit may include a protruding part that protrudes upward therefrom and is configured to be pressed by a lower end portion of the lever.

The image forming apparatus may further include an elastic element by which the developing unit is elastically supported to the photosensitive body unit.

In accordance with an aspect of an exemplary embodiment, an image forming apparatus includes four photosensitive body units, each of which includes a photosensitive body, four developing units that are respectively rotatably mounted to the four photosensitive body units and each of that includes a developing roller configured to contact the photosensitive body or to be separated from the photosensitive body according to rotation thereof, and a press device to press the four developing units to rotate the same. The four developing units include a first developing unit for a black and white image developing process and three second developing units for a color image developing process. The press device includes a first lever to press the first developing unit by rotation thereof, three second levers to respectively press the three second developing units by rotation thereof, a first cam to allow the first lever to rotate by interaction with the first lever, and three second cams to respectively allow the three second levers to rotate by respective interaction with the three second levers.

Since the lever configured to apply force to the developing unit gradually rotates by rotation of the cam, the force applied to the developing unit may also be gradually and smoothly increased or decreased. Accordingly, shock, which may occur by rough movement of the developing unit, for example, is remarkably reduced.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
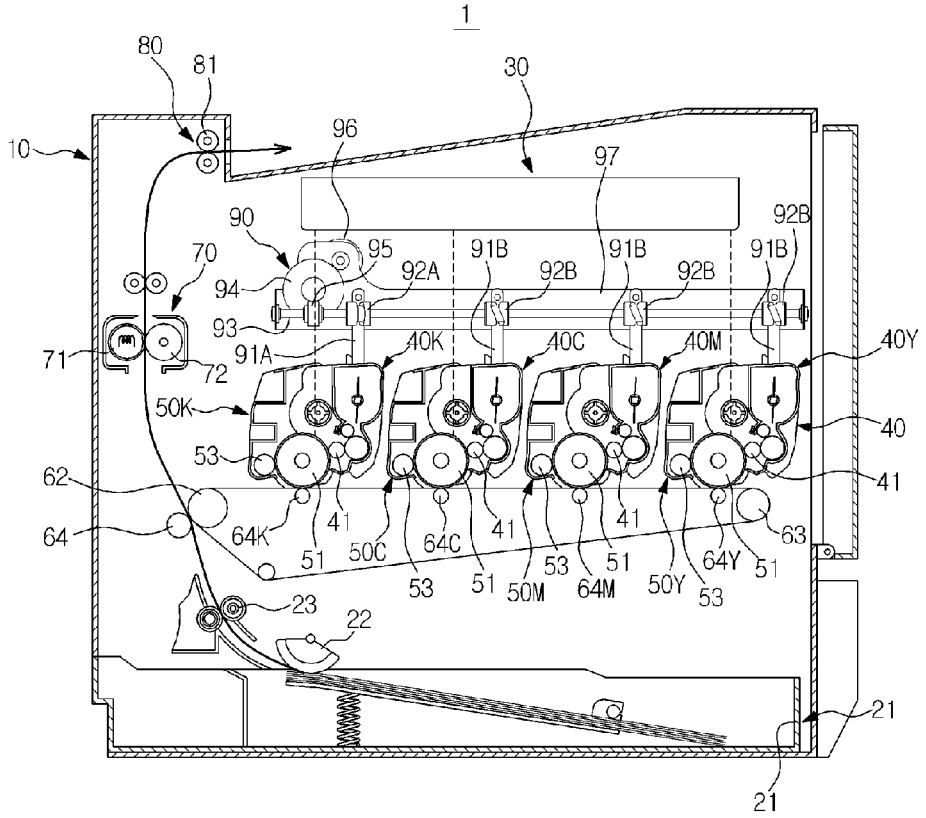
FIG. 1 illustrates an image forming apparatus according to an embodiment.

Reference will now be made in detail to embodiments, examples of which are illustrated in the accompanying drawings, wherein like reference numerals refer to like elements throughout.

FIG. 1 illustrates an image forming apparatus according to an embodiment.

As illustrated in FIG. 1, an image forming apparatus 1 comprises a main body 10, a printing medium feeding unit 20, a laser scanning unit 30, a developing unit 40, a photosensitive body unit 50, a transfer unit 60, a fusing unit 70 and a printing medium discharge unit 80.

The main body 10 forms an exterior appearance of the image forming apparatus 1, and supports components mounted therein.

The printing medium feeding unit 20 includes a cassette 21 to store a printing medium S, a pickup roller 22 to pick up the printing medium S in the cassette 21 sheet by sheet, and a feeding roller 23 to feed the picked-up printing medium toward the transfer unit 60.

The laser scanning unit 30 is configured to irradiate light corresponding to image information to photosensitive bodies 52, thereby forming electrostatic latent images on surfaces of the photosensitive bodies 52.

The developing unit 40 includes a first developing unit 40K to develop a black and white image and three second developing units 40Y, 40M and 40C to develop a color image. The developing unit 40K stores a black (K) developer therein, and the other developing units 40Y, 40M and 40C store yellow (Y), magenta (M) and cyan (C) developers therein, respectively.

Each of the developing units 40Y, 40M, 40C and 40K includes a developing roller 41 and a supply roller 46. The supply roller 46 supplies the developers to the developing roller 41. The developing roller 41 attaches the developers to a surface of the photosensitive body 52, on which an electrostatic latent image is formed, to form a visible image.

The photosensitive body unit 50 includes plural photosensitive body units 50Y, 50M, 50C and 50K that respectively correspond to the plural developing units 40Y, 40M, 40C and 40K. Each of the photosensitive body units 50Y, 50M, 50C and 50K includes a photosensitive body 52 and a charger 53. The photosensitive body 52 is charged to a predetermined electric potential by the charger 53. An electrostatic latent image is formed on the surface of the photosensitive body 52 charged by the charger 53. According to an embodiment, the photosensitive body unit 50 includes a first photosensitive body unit 50K to form a black and white image and three second photosensitive body units 50Y, 50M and 50C to form a color image.

The transfer unit 60 includes a transfer belt 61, a drive roller 62, a driven roller 63, four first transfer rollers 64Y, 64M, 64C and 64K, a second transfer roller 65. The transfer belt 61 circulates in contact with the photosensitive body 52 of each of the photosensitive body units 50Y, 50M, 50C and 50K. The drive roller 62 drives the transfer belt 61 to circulate the same. The driven roller 63 rotates by receiving rotational force through the transfer belt 61. The visible image formed on the photosensitive body 52 of each of the photosensitive body units 50Y, 50M, 50C and 50K is transferred onto the transfer belt 61 by the first transfer rollers 64Y, 64M, 64C and 64K. The second transfer roller 65 opposes the drive roller 62 while the transfer belt 61 is interposed therebetween. The visible image on the transfer belt 61 is transferred onto a printing medium by the second transfer roller 65.

The fusing unit 70 includes a heating roller 71 having a heat source and a press roller 72 that opposes the heating roller 71. A printing medium onto which an image has been transferred passes between the heating roller 71 and the press roller 72. The image may be fused to the printing medium by heat transmitted from the heating roller 71 and a pressure generated between the heating roller 71 and the press roller 72.

The printing medium discharge unit 80 includes a discharge roller 81. A printing medium passing through the fusing unit 70 is guided to the printing medium discharge unit 80, and then may be discharged to the outside of the main body 10 by the discharge roller 81.

When image formation is performed, the developing roller 41 of each of the developing units 40Y, 40M, 40C and 40K is in contact with the photosensitive body 52 in order to supply the developers to the photosensitive body 52. However, when the image forming is not performed, the developing roller 41 is separated from the photosensitive body 52.

To achieve this, the developing units 40Y, 40M, 40C and 40K are rotatably mounted to the photosensitive body units 50Y, 50M, 50C and 50K, and a press device 90 is disposed above the developing units 40Y, 40M, 40C and 40K so as to apply force to the developing units 40Y, 40M, 40C and 40K to rotate the same.

Figure 2:
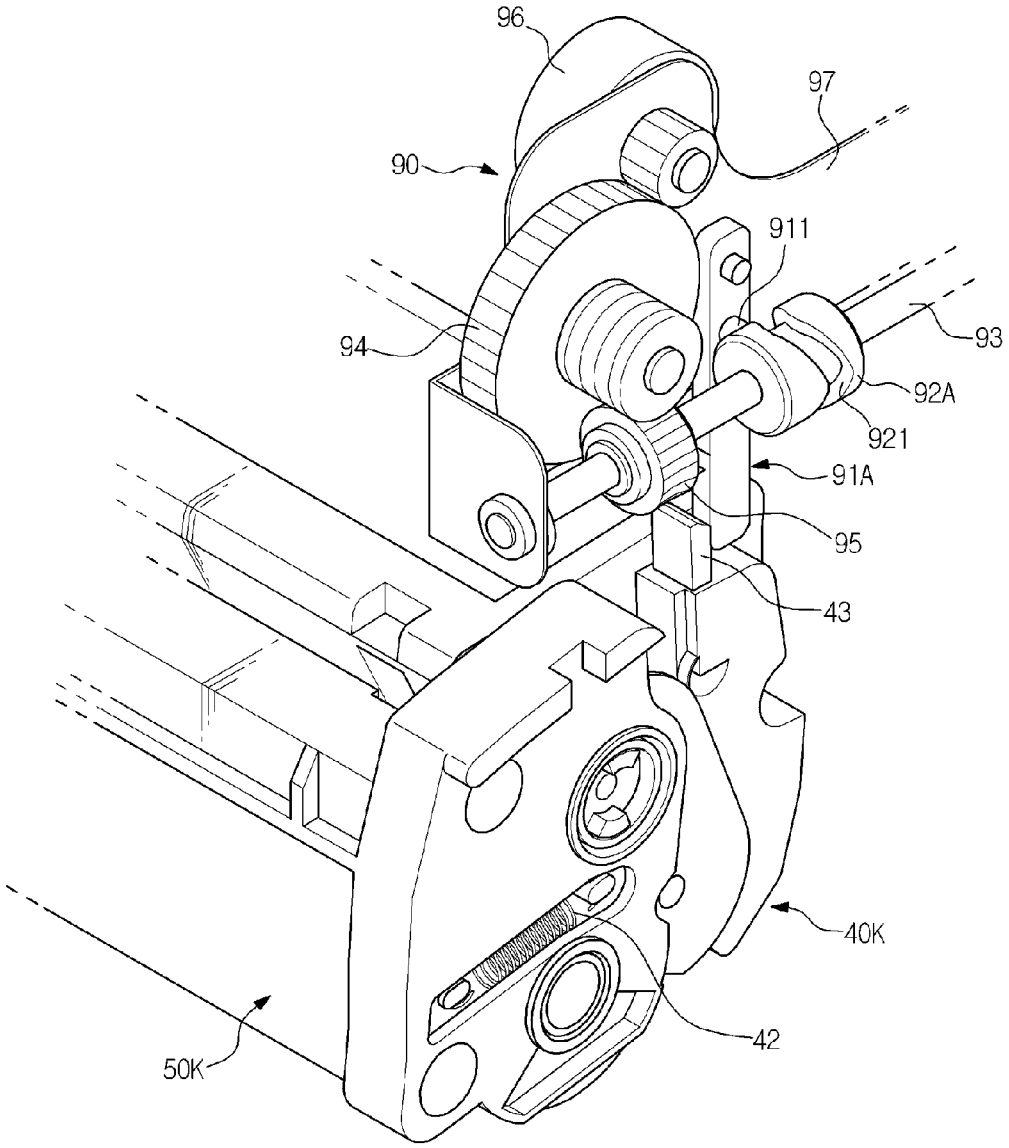
FIG. 2 illustrates a developing unit, a photosensitive body unit and a press device of an image forming apparatus according to an embodiment.

An exemplary mounting structure of the first developing unit 40K, the first photosensitive body unit 50K and a first lever 91A and a first cam 92A of the press device 90 is illustrated in FIG. 2. Although not illustrated in the drawings, the mounting structure of the second developing units 40Y, 40M and 40C, the second photosensitive body units 50Y, 50M and 50C and a second lever 91B and a second cam 92B of the press device 90 is the same as illustrated in FIG. 2.

An elastic element 42 may be mounted between each of the photosensitive body units 50K, 50Y, 50M and 50C and each of the developing units 40K, 40Y, 40M and 40C. The elastic element 42 serves to elastically bias the developing units 40K, 40Y, 40M and 40C toward the photosensitive body units 50K, 50Y, 50M and 50C, so that the developing units 40K, 40Y, 40M and 40C return to original positions after being rotated by the press device 90. Each of the developing units 40K, 40Y, 40M and 40C may be provided with a protruding part 43 at a top portion thereof to receive force from the press device 90.

Figure 3:
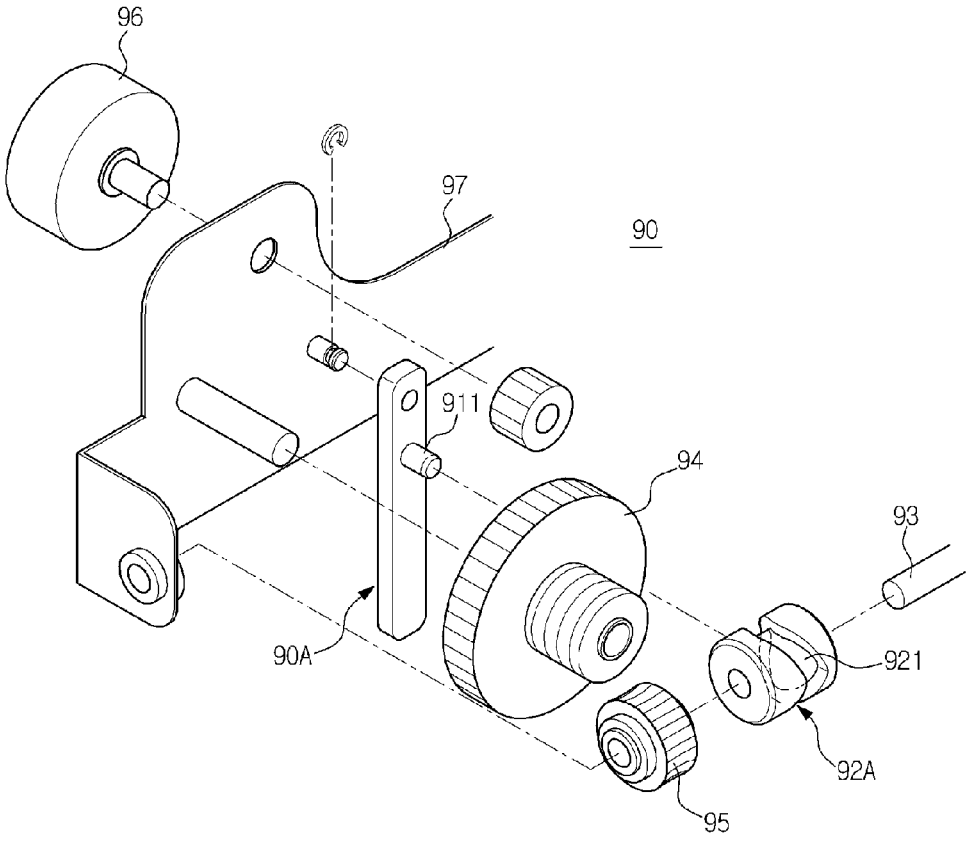
FIG. 3 illustrates a press device of an image forming apparatus according to an embodiment.

As illustrated in FIGS. 2 and 3, the press device 90 includes levers 91A and 91B that are rotatably mounted thereto and apply force to the protruding parts 43 of the developing units 40K, 40Y, 40M and 40C by rotation, and cams 92A and 92B that are rotatably mounted thereto and allow the levers 91A and 91B to rotate. According to an embodiment, the number of the levers 91A and 91B and the number of the cams 92A and 92B are respectively four in order to independently operate the four developing units 40K, 40Y, 40M and 40C. The four levers 91A and 91B may be rotatably mounted to a support bracket 97 that is mounted in the main body 10.

The press device 90 includes a drive shaft 93 rotatably mounted to the support bracket 97, on which the four cams 92A and 92B may be arranged apart from each other in an axial direction thereof, a worm 94 configured to rotate by receiving rotational force from a drive motor (not shown), and a worm wheel 95 coupled to the drive shaft 93 and tooth-engaged with the worm 94 so as to rotate the drive shaft 93 by being rotated by the worm 94.

Upper end portions of the levers 91A and 91B may be rotatably mounted to the support bracket 97. Accordingly, while rotating about the upper end portions thereof, lower end portions of the levers 91A and 91B apply force to the protruding parts 43. One of the levers 91A and 91B is a first lever 91A to press the first developing unit 40K, and the others are three second levers 91B to respectively press the second developing units 40Y, 40M and 40C.

The levers 91A and 91B respectively include guide parts 911 that are respectively guided by the cams 92A and 92B corresponding to the levers 91A and 91B. According to an embodiment, each of the guide parts 911 may be a guide protrusion that protrudes from a lateral surface of each of the levers 91A and 91B.

One of the cams 92A and 92B is a first cam 92A to rotate the first lever 91A configured to press the first developing unit 40K, and the others are three second cams 92B to respectively rotate the three second levers 91B configured to respectively press the three second developing units 40Y, 40M and 40C.

Each of the cams 92A and 92B includes a cam portion 921 that is formed in a circumferential direction thereof to guide each of the guide parts 911. According to an embodiment, the cam portion 921 is a cam recess having a concave shape into which the guide part 911 (guide protrusion) may be inserted.

Figure 4:
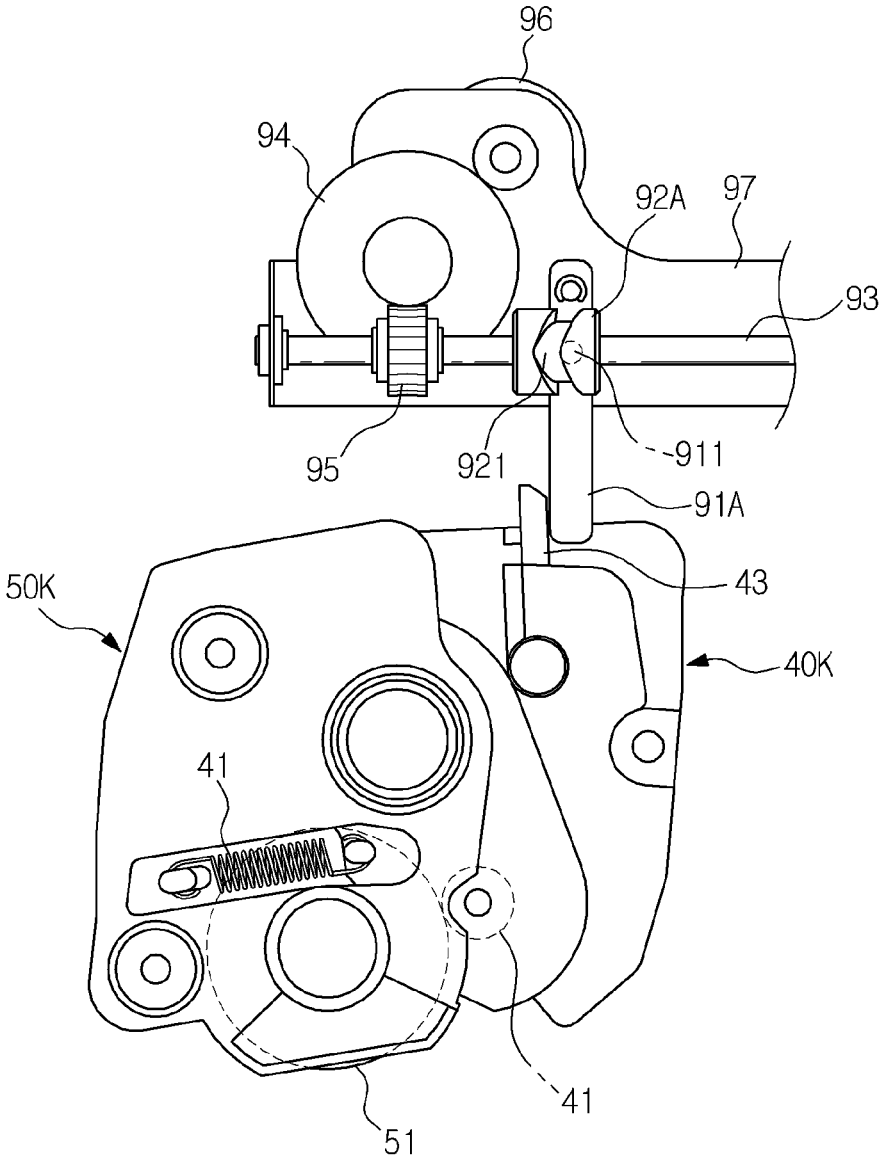
FIGS. 4 and 5 illustrate exemplary operational states of a press device of an image forming apparatus according to an embodiment.
Figure 5:
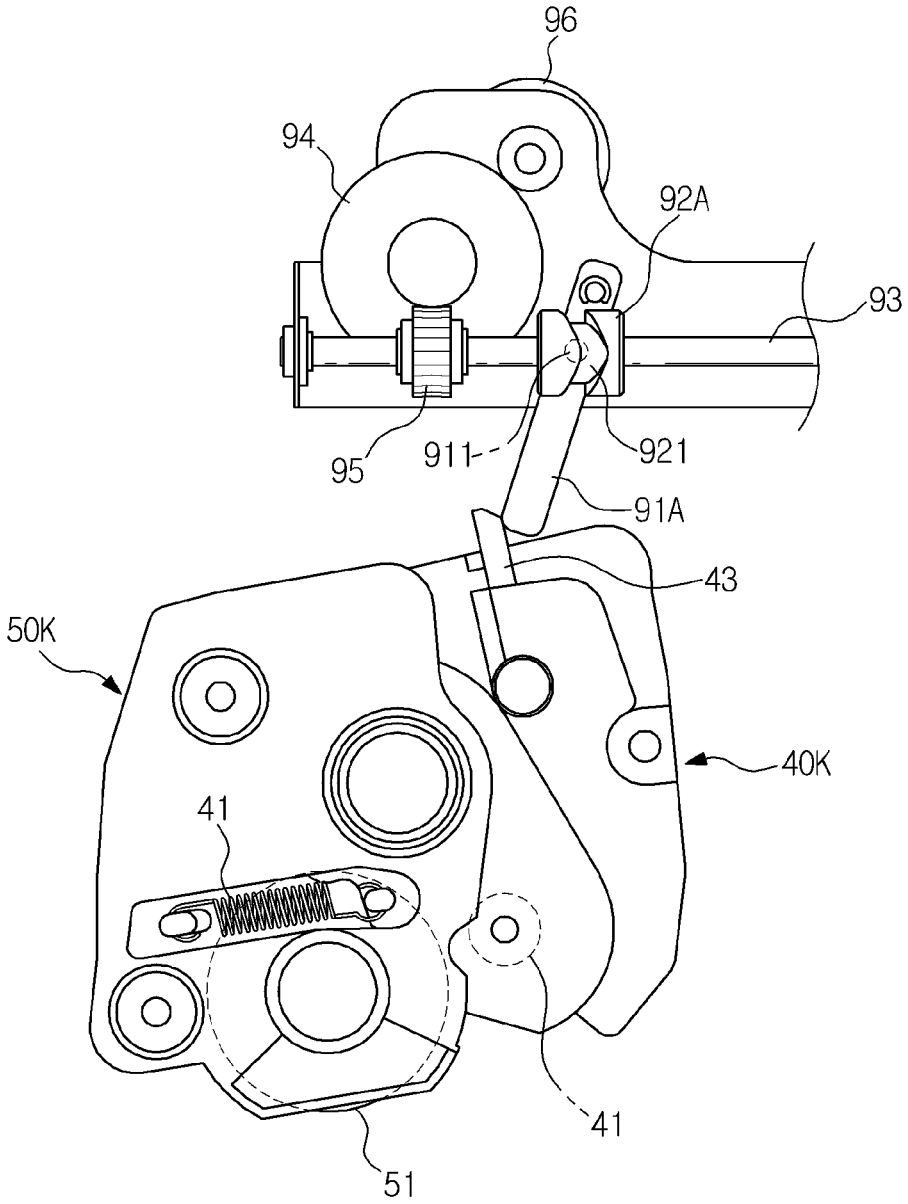
Figure 6:
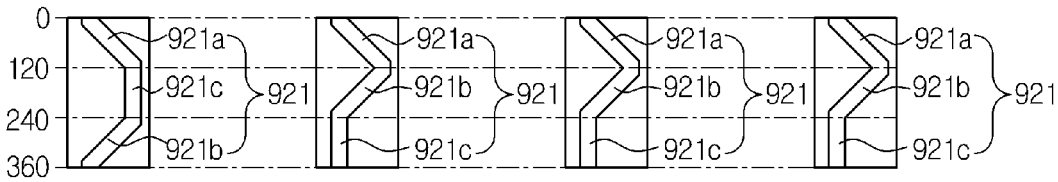
FIG. 6 illustrates an exemplary embodiment of cams of an image forming apparatus according to an embodiment.

The cam portion 921, as illustrated in FIGS. 4 through 6, includes a first cam portion 921*a*, a second cam portion 921*b* and a third cam portion 921*c*. The first cam portion 921*a* extends obliquely in a first direction to guide the guide part 911 in the first direction, thereby rotating each of the levers 91A and 91B in the first direction. The second cam portion 921*b* extends obliquely in a second direction, which is opposite to the first direction, to guide the guide part 911 in the second direction, thereby rotating each of the levers 91A and 91B in the second direction. The third cam portion 921*c* extends in parallel with the rotating direction of each of the cams 92A and 92B, so that each of the levers 91A and 91B is kept in a stationary state even though each of the cams 92A and 92B rotates. According to an embodiment, as each of the levers 91A and 91B rotates in the first direction, the developing roller 41 is in contact with the photosensitive body 52. As each of the levers 91A and 91B rotates in the second direction, the developing roller 41 is separated from the photosensitive body 52.

According to an embodiment, during one rotation of the drive shaft 93, the image forming apparatus performs a stand-by mode, a color print mode and a black and white print mode, for example, in order. In the stand-by mode, all the developing rollers 41 may be spaced apart from the photosensitive bodies 52. In the color print mode, all the developing rollers 41 may be in contact with the photosensitive bodies 52 to print a color image. In the black and white print mode, only the first developing roller 41 may be in contact with the photosensitive body 52 and the other second developing rollers 41 may be spaced apart from the photosensitive bodies 52 to print a black and white image. In other words, the operational mode of the developing units 40K, 40Y, 40M and 40C is repeatedly changed to the stand-by mode, the color print mode and the black and white print mode, for example, in order according to the rotation of the drive shaft 93.

To achieve such sequential change of the operational mode of the developing units 40K, 40Y, 40M and 40C (i.e., the stand-by mode, the color print mode and the black and white print mode), the cam portion 921 formed at the first cam 92A may be shaped such that the first cam portion 921*a*, the third cam portion 921*c* and the second cam portion 921*b* are connected in order in a circumferential direction of the first cam 92A. However, the cam portion 921 formed at each of the second cams 92B may be shaped such that the first cam portion 921*a*, the second cam portion 921*b* and the third cam portion 921*c* are connected in order in a circumferential direction of the second cams 92B. According to an embodiment, the first cam portion 921*a*, the second cam portion 921*b* and the third cam portion 921*c* respectively extend by an angle of 120 degrees.

An exemplary operation of an image forming apparatus according to an embodiment is described.

At an initial stage, the developing rollers 41 of all the developing units 40K, 40Y, 40M and 40C may be separated from the photosensitive bodies 52. Therefore, the image forming apparatus is in a state incapable of performing an image forming process. When image formation is required, if the drive shaft 93 is rotated, for example, by an angle of 120 degrees by the drive motor 96, the cams 92A and 92B also rotate, for example, by an angle of 120 degrees according to the rotation of the drive shaft 93.

According to the rotation of the cams 92A and 92B, the guide parts 911 provided at the levers 91A and 91B may be guided in the first direction by the first cam portions 921*a* formed at the cams 92A and 92B. Accordingly, the levers 91A and 91B rotate in the first direction, and the force applied to the developing units 40K, 40Y, 40M and 40C is removed. If the force applied to the developing units 40K, 40Y, 40M and 40C is removed, the developing units 40K, 40Y, 40M and 40C rotate by elastic restoring force of the elastic elements 42, and the developing rollers 41 provided at the developing units 40K, 40Y, 40M and 40C come into contact with the photosensitive bodies 52 provided at the photosensitive body units 50K, 50Y, 50M and 50C, respectively. As a result, the operational mode of the image forming apparatus is switched to a mode capable of forming a color image.

If the drive shaft 93 is rotated another 120 degrees, the guide part 911 provided at the first lever 91A is kept in a stationary state, after being guided in the first direction, by the third cam portion 921*c* formed at the first cam 92A. Therefore, the developing roller 41 of the first developing unit 40K is kept in contact with the photosensitive body 52 of the first photosensitive body unit 50K.

The guide parts 911 provided at the second levers 91B may be guided in the second direction by the second cam portions 921*b* formed at the second cams 92B. Accordingly, the second levers 91B rotate in the second direction and apply force to the second developing units 40Y, 40M and 40C.

If force is applied to the second developing units 40Y, 40M and 40C by the second levers 91B, the second developing units 40Y, 40M and 40C rotate such that the developing rollers 41 provided at the second developing units 40Y, 40M and 40C are separated from the photosensitive bodies 52 provided at the second photosensitive body units 50Y, 50M and 50C. Accordingly, color image formation is not achieved.

An operational mode of the image forming apparatus may be switched to a mode capable of forming only a black and white image, in which the developing roller 41 of the first developing unit 40K for black and white image forming is in contact with the photosensitive body 52 of the first photosensitive body unit 50K and the developing rollers 41 of the second developing units 40Y, 40M and 40C for color image forming are separated from the photosensitive bodies 52 of the second photosensitive body units 50Y, 50M and 50C.

From such an operational mode, if the drive shaft 93 is rotated, for example, another 120 degrees, the guide part 911 provided at the first lever 91A may be guided in the second direction by the second cam portion 921*b* formed at the first cam 92A. Accordingly, the first lever 91A rotates in the second direction and applies force to the first developing unit 40K. If force is applied to the first developing unit 40K by the first lever 91A, the first developing unit 40K rotates such that the developing roller 41 provided at the first developing unit 40K is separated from the photosensitive body 52 provided at the first photosensitive body unit 50K. Accordingly, black and white image formation is not achieved.

The second levers 91B may be kept in a stationary state, after rotating in the second direction, by the third cam portions 921*c* formed at the second cams 92B. Therefore, the developing rollers 41 of the second developing units 40Y, 40M and 40C may be kept separated from the photosensitive bodies 52 of the second photosensitive body units 50Y, 50M and 50C. Accordingly, color image formation is not achieved.

An image forming apparatus may return to the state incapable of performing an image forming process, in which the developing rollers 41 of all the developing units 40K, 40Y, 40M and 40C are separated from the photosensitive bodies 52 of the photosensitive body units 50K, 50Y, 50M and 50C.

According to an embodiment, the operational mode of the image forming apparatus may be repeatedly changed to the stand-by mode, the color print mode and the black and white print mode in order according to the rotation of the drive shaft 93. According to an embodiment, the operational mode may be changed to the stand-by mode, the black and white print mode and the color print mode in order.

Figure 7:
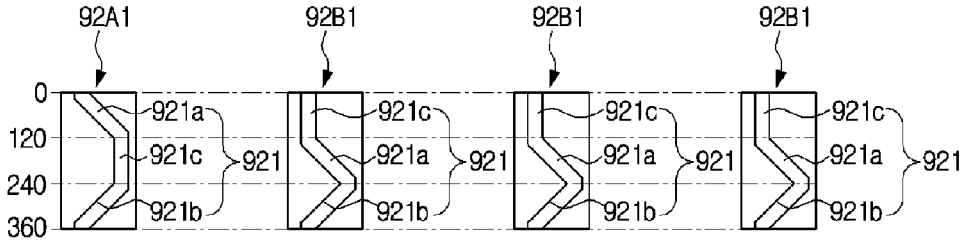
FIG. 7 illustrates an exemplary embodiment of cams of an image forming apparatus according to an embodiment.

To achieve such sequential change of the operational mode, i.e., the stand-by mode, the black and white print mode and the color print mode, of the developing units 40K, 40Y, 40M and 40C, as illustrated in FIG. 7, the cam portion 921 formed at the first cam 92A1 is shaped such that the first cam portion 921*a*, the third cam portion 921*c* and the second cam portion 921*b* are connected in order in a circumferential direction of the first cam 92A1. The cam portion 921 formed at each of the second cams 92B1 may be shaped such that the third cam portion 921*c*, the first cam portion 921*a* and the second cam portion 921*b* are connected in order in a circumferential direction of the second cams 92B1. According to an embodiment, the first cam portion 921*a*, the second cam portion 921*b* and the third cam portion 921*c* respectively extend, for example, by an angle of 120 degrees.

According to an embodiment, an operational mode of the developing units 40K, 40Y, 40M and 40C may be changed to the stand-by mode and the color print mode alternately according to the rotation of the drive shaft 93.

Figure 8:
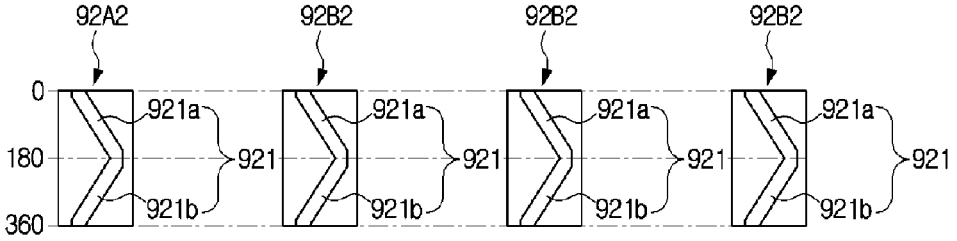
FIG. 8 illustrates an exemplary embodiment of cams of an image forming apparatus according to an embodiment.

As illustrated in FIG. 8, each of the cam portions 921 formed at the cams 92A2 and 92B2 may be shaped such that the first cam portion 921*a* and the second cam portion 921*b* are connected in order in a circumferential direction of the cams. The first cam portion 921*a* and the second cam portion 921*b* respectively extend, for example, by an angle of 180 degrees.

Figure 9:
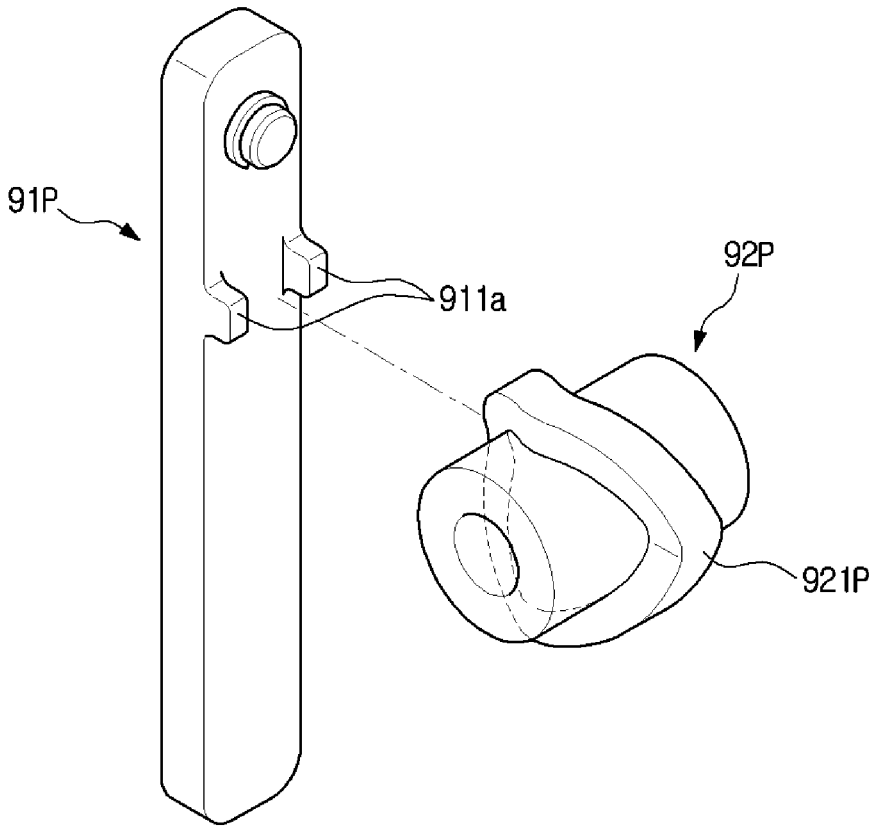
FIG. 9 illustrates an exemplary embodiment of a lever and a cam of an image forming apparatus according to an embodiment.

According to an embodiment, a guide part 911 is a single guide protrusion and the cam portion 921 is a cam recess into which the guide part 911 is inserted. However, as illustrated in FIG. 9, an exemplary embodiment includes a guide part 911*a* that includes a pair of guide protrusions that are provided at a lever 91P and spaced apart from each other and a cam portion 921P of a cam 92P is a cam protrusion that may be inserted between the pair of guide protrusions of the guide part 911*a*.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a photosensitive body unit including a photosensitive body;

at least one developing unit including a developing roller that is configured to contact the photosensitive body or to be separated from the photosensitive body; and a press device to press the developing unit in order to contact or separate the photosensitive body and the developing roller to/from each other, wherein the press device includes at least one lever configured to rotate about an end portion thereof and press the developing unit by rotation, and at least one cam configured to allow the lever to rotate by rotation thereof, wherein the cam includes a cam portion that extends in a circumferential direction thereof, and the lever includes a guide part that interacts with the cam portion so that the lever rotates in an axial direction of the cam.

2. The image forming apparatus according to claim 1, wherein the cam portion includes a cam recess that is concavely formed at an outer peripheral surface of the cam, and the guide part includes a guide protrusion that protrudes from the lever and is inserted into the cam recess.

3. The image forming apparatus according to claim 1, wherein the cam portion includes a cam protrusion that is convexly formed at an outer peripheral surface of the cam, and the guide part includes a pair of guide protrusions that protrude from the lever and between which the cam protrusion is inserted.

4. The image forming apparatus according to claim 1, wherein the cam portion includes a first cam portion that extends obliquely in a first direction and a second cam portion that extends obliquely in a second direction that is opposite to the first direction.

5. The image forming apparatus according to claim 4, wherein the at least one developing unit includes plural developing units, the at least one lever includes plural levers to respectively press the plural developing units, the at least one cam includes plural cams that respectively correspond to the plural levers, and the cam portion of each of the plural cams is shaped such that the first cam portion and the second cam portion are connected in order in a circumferential direction of the cam.

6. The image forming apparatus according to claim 5, wherein the first cam portion and the second cam portion respectively extend by an angle of 180 degrees in a circumferential direction of the cam.

7. The image forming apparatus according to claim 4, wherein the cam portion further includes a third cam portion that extends in parallel with a rotating direction of the cam.

8. The image forming apparatus according to claim 7, wherein the at least one developing unit includes a first developing unit for a black and white developing process and plural second developing units for a color developing process, the at least one lever includes a first lever to press the first developing unit and plural second levers to respectively press the plural second developing units, the at least one cam includes a first cam to rotate the first lever and plural second cams to respectively rotate the plural second levers, the cam portion of the first cam is shaped such that the first cam portion, the third cam portion and the second cam portion are connected in order in a circumferential direction of the first cam, and the cam portion of each of the plural second cams is shaped such that the first cam portion, the second cam portion and the third cam portion are connected in order in a circumferential direction of the second cams.

9. The image forming apparatus according to claim 7, wherein the at least one developing unit includes a first developing unit for a black and white developing process and plural second developing units for a color developing process, the at least one lever includes a first lever to press the first developing unit and plural second levers to respectively press the plural second developing units, the at least one cam includes a first cam to rotate the first lever and plural second cams to respectively rotate the plural second levers, the cam portion of the first cam is shaped such that the first cam portion, the third cam portion and the second cam portion are connected in order in a circumferential direction of the first cam, and the cam portion of each of the plural second cams is shaped such that the third cam portion, the first cam portion and the second cam portion are connected in order in a circumferential direction of the second cams.

10. The image forming apparatus according to claim 7, wherein the first cam portion, the second cam portion and the third cam portion respectively extend by an angle of 120 degrees in a circumferential direction of the cam.

11. The image forming apparatus according to claim 1, further comprising:

a drive shaft, wherein the at least one cam includes plural cams coupled to the drive shaft, and the plural cams are arranged apart from each other in an axial direction of the drive shaft.

12. The image forming apparatus according to claim 11, wherein the press device includes a worm configured to rotate by receiving rotational force and a worm wheel that is coupled to the drive shaft and tooth-engaged with the worm.

13. The image forming apparatus according to claim 1, wherein the developing unit is rotatably coupled to the photosensitive body unit, and the press unit presses the developing unit to rotate the same so that the developing roller comes into contact with the photosensitive body.

14. The image forming apparatus according to claim 13, wherein the developing unit includes a protruding part that protrudes upward therefrom and is configured to be pressed by a lower end portion of the lever.

15. The image forming apparatus according to claim 13, further comprising:

an elastic element by which the developing unit is elastically supported to the photosensitive body unit.

16. An image forming apparatus comprising:

four photosensitive body units, each of which includes a photosensitive body;

four developing units that are respectively rotatably mounted to the four photosensitive body units and each of which includes a developing roller configured to contact the photosensitive body or to be separated from the photosensitive body according to rotation thereof; and a press device to press the four developing units to rotate the same, wherein the four developing units include a first developing unit for a black and white image developing process and three second developing units for a color image developing process, and the press device includes a first lever to press the first developing unit by rotation thereof, three second levers to respectively press the three second developing units by rotation thereof, a first cam to allow the first lever to rotate by interaction with the first lever, and three second cams to respectively allow the three second levers to rotate by respective interaction with the three second levers, wherein the first lever includes a first guide part that is guided by the first cam, the second levers include second guide parts that are respectively guided by the second cams, the first cam includes a cam portion that extends in a circumferential direction thereof to guide the first guide part, and the second cams include cam portions that extends in a circumferential direction thereof to respectively guide the second guide parts.

17. The image forming apparatus according to claim 16, wherein the cam portion of the first cam and the cam portion of each of the second cams respectively include a first cam portion that extends obliquely in a first direction, a second cam portion that extends obliquely in a second direction that is opposite to the first direction, and a third cam portion that extends in parallel with a rotating direction of the first cam and the second cams.

18. The image forming apparatus according to claim 17, wherein the cam portion of the first cam is shaped such that the first cam portion, the third cam portion and the second cam portion are connected in order in a circumferential direction of the first cam, and the cam portion of each of the second cams is shaped such that the first cam portion, the second cam portion and the third cam portion are connected in order in a circumferential direction of the second cams.

19. The image forming apparatus according to claim 17, wherein the cam portion of the first cam is shaped such that the first cam portion, the third cam portion and the second cam portion are connected in order in a circumferential direction of the first cam, and the cam portion of each of the second cams is shaped such that the third cam portion, the first cam portion and the second cam portion are connected in order in a circumferential direction of the second cams.

* * * * *